United States Patent [19]

Herubel

[11] 4,137,701

[45] Feb. 6, 1979

[54] DEVICE FOR FACILITATING THE DOFFING OF FULL BOBBINS ON FLY-FRAMES

[75] Inventor: Jean F. Herubel, Guebwiller, France

[73] Assignee: N. Schlumberger & Cie, Guebwiller, France

[21] Appl. No.: 854,335

[22] Filed: Nov. 23, 1977

[30] Foreign Application Priority Data

Dec. 3, 1976 [FR] France ..... 76 36470

[51] Int. Cl.[2] ..... D01H 9/00; D01H 7/26

[52] U.S. Cl. ..... 57/267; 57/276; 57/67; 57/115

[58] Field of Search ..... 57/52–54, 57/115, 67

[56] References Cited

U.S. PATENT DOCUMENTS

| | | | |
|---|---|---|---|
| 1,263,714 | 4/1918 | Stell | 57/52 |
| 2,658,325 | 11/1953 | Haythornthwaite et al. | 57/52 |
| 2,962,856 | 12/1960 | Ingham, Jr. | 57/52 |
| 3,380,238 | 4/1968 | Araki et al. | 57/52 |
| 3,935,699 | 2/1976 | Iida et al. | 57/52 |
| 4,044,536 | 8/1977 | Stone | 57/52 |

*Primary Examiner*—John Petrakes

*Attorney, Agent, or Firm*—Toren, McGeady and Stanger

[57] ABSTRACT

The doffing of full bobbins built on spools placed on the vertical spindles of fly-frames equipped with revolving flyers is performed by combining gripping means such as resilient clips carried by each flyer with retaining means such as an annular groove formed at the upper end of each spool. The releasable axial coupling thus provided is capable of temporarily supporting a spool and full bobbin in the top position while the spindle is moved downwards in order to remove the spool.

4 Claims, 4 Drawing Figures

DEVICE FOR FACILITATING THE DOFFING OF FULL BOBBINS ON FLY-FRAMES

This invention relates to a device for facilitating the doffing of full bobbins built on spools placed on revolving and up-and-down motion spindles of fly-frames equipped with revolving flyers which are mounted coaxially above said spindles. The device is intended to be employed in the textile industry in spinning and operations preparatory to spinning.

Doffing of full bobbins on fly-frames is usually performed by moving the spindles to the bottom position, disengaging the bobbins from the spindles on which they are placed, then displacing them in sliding motion by lifting them to the top of the spindles and finally removing them. Such an operation in fact proves both tiring and particularly awkward when it is necessary to carry out the doffing of full bobbins located in the back row of a fly-frame having a double row of spindles.

In order to overcome this drawback, it has already been proposed to make use of a device comprising a horizontal sheet metal member provided with holes opposite to the spindles and supported by the spindle carriage by means of a system which permits vertical displacement of said sheet metal member with respect to the carriage; the diameter of the holes formed in the sheet metal member is slightly larger than that of the spools. Thus, in order to doff the full bobbins, it is only necessary to move the sheet metal member upwards over a predetermined distance with respect to the carriage in order to ensure that the edges of the holes of the sheet metal member exert a vertical pressure which is directed upwards against the lower ends of the bobbins. The result thereby achieved is that the bobbins are disengaged from the spindles and then lifted so that they can more readily be removed from the spindles. This arrangement is nevertheless subject to disadvantages. In fact the presence of the device has the effect of increasing the weight of the spindle carriage whereas it is always considered a desirable objective to minimize its weight with a view to reducing fatigue of the corresponding machine components. Furthermore, this device causes a certain amount of damage to the bobbins since the edges of the holes formed in the sheet metal members apply pressure directly against the textile material of the bobbins in order to disengage and lift these latter. Damaging of the bobbins constitutes an obstacle to their subsequent use in other machines.

The aim of the invention is to propose a device which facilitates doffing of full bobbins or fly-frames, which is of very simple design but which is not subject to the above-mentioned disadvantages of the known means recalled in the foregoing.

To this end, the device in accordance with the invention is characterized by the combination of gripping means carried by each flyer and associated retaining means rigidly fixed to the top end of each spool, said means being intended to form together a releasable axial coupling which is capable of temporarily supporting a spool fitted with a bobbin in the top position while the spindle is moved downwards in order to remove the filled spool from said spindle.

The practical result achieved by this device is that the full bobbins are disengaged from the spindles mechanically, the operator being only required to take hold of them at the level at which they are normally placed and to draw them towards him in order to free them from the machine; the operator is no longer required to lift the bobbins and slide them to the top of the spindles. It should be borne in mind that these bobbins are relatively heavy since they weigh between 4 and 5 kilograms.

A further advantage of said device lies in the fact that it does not have the effect of increasing the weight of the spindle carriage or of damaging the textile material of the bobbins. The device also permits the use of standard spools since it is possible in accordance with another distinctive feature of the invention to provide the retaining means aforesaid in the form of a simple annular groove formed in the upper end of the spool.

A more complete understanding of the invention will be gained from a perusal of the following description and from a study of the accompanying drawings which show by way of example a few embodiments of a device in accordance with the invention for facilitating the doffing of full bobbins on a fly-frame, and in which.

Figure 1:
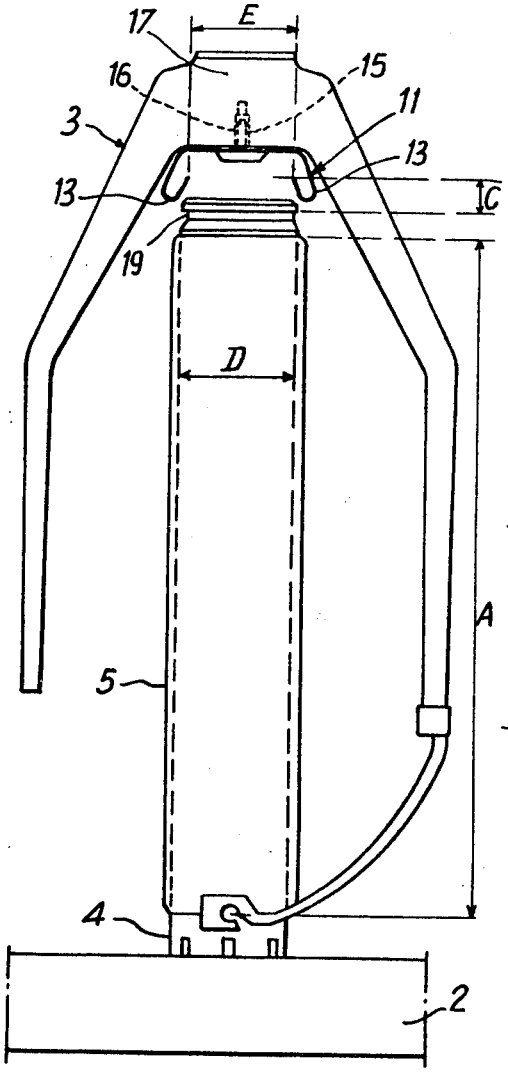
FIG. 1 is a view in elevation showing a flyer and bobbin unit carried by a fly-frame carriage during building of the coil, said unit being equipped with a device in accordance with the invention.
Figure 3:
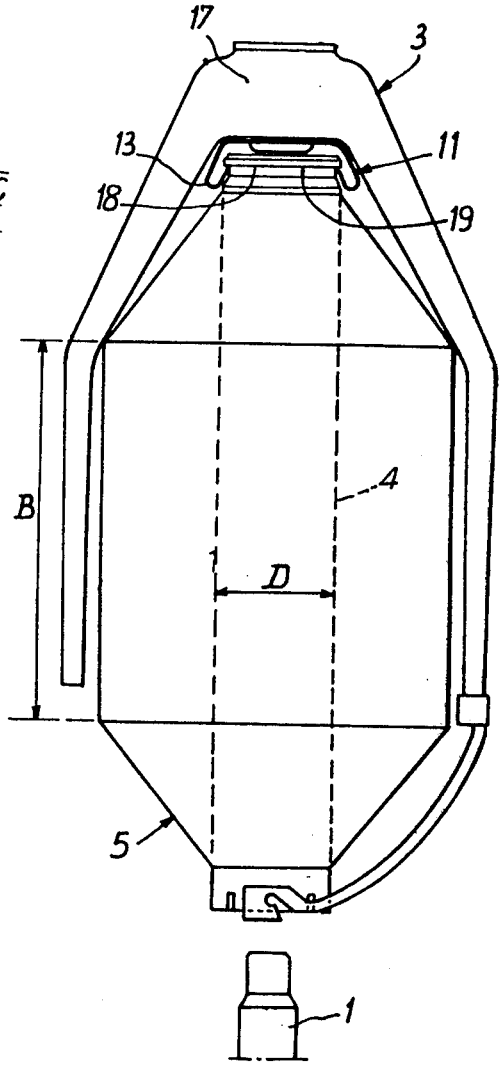
FIG. 3 is a view which is similar to FIG. 1 and shows the unit at the moment when the full bobbin presented by the device is ready to be removed from the machine.
Figure 2:
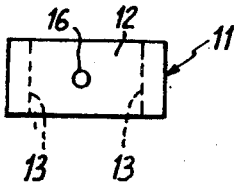
FIG. 2 is a plan view of the resilient clip for temporarily supporting the spool, said clip being shown alone.

Referring first to FIGS. 1 to 3, there is shown a vertical revolving fly-frame spindle 1 supported by an up-and-down motion carriage 2 and a rotary flyer 3 mounted coaxially above the spindle in accordance with a conventional technique. A spool 4 is engaged and wedged on the spindle 1 and a bobbin 5 of textile material is formed on said spool.

A device for facilitating the removal of the full bobbin 5 shown in FIG. 3 comprises gripping means on the flyer 3 and retaining means on the spool 4. In the example shown, the gripping means are constituted by a resilient clip 11 formed by a small plate 12 having the general shape of an elongated rectangle, the two ends of which are curved first downwards, then inwards and upwards so as to form two resilient claws 13. The ends of the two claws are inclined both upwards and towards each other so as to form between them a wedge-shaped space having a thickness "E" which is slightly smaller than the diameter "D" of the spool. The clip 11 is secured by means of a screw 15 which passes through a central hole 16 of the small plate 12 and is mounted in the central portion of the body 17 of the flyer 3, the longitudinal axis of the small plate 12 being located in the longitudinal mid-plane of the flyer 3.

The retaining means are constituted by an annular flange 18 formed by the upper lateral wall of an annular groove 19, said groove being formed in the top portion of the spool 4 very close to the end face of this latter.

The operation of the device is as follows:

During building of the bobbin 5, the range of up-and-down travel of the spindle carriage 2 has a length "A" (as shown in FIG. 1) at the outset, then decreases progressively to a value "B" (as shown in FIG. 2) when the bobbin is completed. However, the height reached by the bobbin in the position of maximum height for the last winding layer is such that the upper end of the spool is located at a fairly substantial distance below the fastening clip 11. For the doffing operation, it is accordingly necessary to move the carriage 2 upwards to a position which places the upper end of the spool at a height "C" (as shown in FIG. 1) above its highest level at the time of completion of the winding operation of the bobbin; during this movement, the upper end of the spool which has a diameter "D" produces a slight outward displacement of the claws 13 from the normal value of relative spacing "E" which is smaller than "D" until the moment when the annular groove 19 of the spool is located opposite to the ends of the claws which then fall into said annular groove (as shown in FIG. 3) and are capable of supporting the full bobbin in the top position. The carriage 2 is then moved downwards to its bottom position in which the upper end of the spindle 1 is located at a lower level than the level of the lower end of the bobbin. At the beginning of the downward movement of the carriage, the spindle 1 which is rigidly fixed to said carriage has been disengaged from the spool filled with the bobbin and fastened to the clip 11 which is rigidly fixed to the flyer 3. The spindle has then moved downwards in sliding motion until it has completely withdrawn from the spool (as shown in FIG. 3). The operator needs only disengage the full bobbin from the clip 11 by means of a horizontal movement exerted in a direction at right angles to the plane of the drawing, that is to say at right angles to the longitudinal midplane of the flyer 3, whilst the ends of the claws 13 simply slide within the annular groove 19 of the spool. The spindle 1 is ready to receive another empty spool for starting a further winding cycle.

Figure 4:
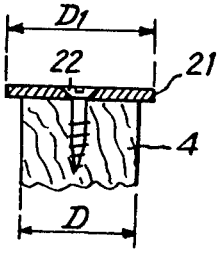
FIG. 4 is a sectional view of alternative means for retaining the spool.

In FIG. 4, there is shown an alternative design of retaining means constructed in the form of a washer 21 of metal, for example, and fixed on the upper end of the spool 4 by means of a screw 22. The external diameter "D1" of the washer is slightly larger than the diameter "D" of the spool and the distance "E" between the ends of the two claws 13 of the clip would in that case be substantially equal to the value of the diameter "D" of the spool. The edge portion of the underface of the washer 21 accordingly performs the function of upper lateral wall of the annular groove 19 of the embodiment described earlier.

As can readily be understood, the invention is not limited to the embodiments herein described and illustrated. Depending on the applications which may be contemplated, many modifications can accordingly be made without thereby departing either from the scope or the spirit of the invention.

It accordingly follows, for example, that the spool-retaining means can consist of an insert of metal or the like or in other words a kind of washer or circlip placed within a groove located at the upper end of the spool and adapted to form an annular shoulder in order to be retained by the gripping means constituted by the resilient claws.

Similarly, the gripping spring or resilient clip can be replaced by jaws, by a type of retractable horizontal lugs which are intended to engage within the groove of the spool or by any suitable resilient device for retaining the spool by means of the groove which is designed for this purpose.

We claim:

1. In a fly frame having spindle means mounted for rotation and vertical axial movement, spools frictionally engaged on said spindle means to have bobbins of textile material formed on said spools, and revolving flyer means coaxially mounted above said spindle means and each having a central portion with an underface, the improvement of clamping means carried by said flyer means for temporarily clamping said spool onto said flyer means, said improvement comprising two opposed resilient claws secured to said underface of said central portion of said flyer means and resiliently deformable away from each other, said claws having two clamping edges facing each other, and annular retaining flange means on the upper end portion of each of said spools mating with said two clamping edges of said resilient claws, said flange means having an inner diameter equal to the distance between said clamping edges of said two claws and an outer diameter greater than said distance, said annular retaining flange means being mechanically engaged between said two clamping edges of said claws upon upward movement of said spindle means and of a spool carried thereon, said retaining flange means being disengaged from between said clamping edges by manual lateral movement of said spool.

2. The improvement of claim 1 wherein said two opposed resilient claws are formed by end portions of a resilient plate of generally rectangular shape secured to said underface of said central portion of said flyer means, said two clamping edges being formed by said end portions of said resilient plate being curved first downwardly and then inwardly and upwardly in inclined directions toward each other.

3. The improvement of claim 1 wherein said annular retaining flange means are formed by the marginal portion of a circular disk having a diameter greater than the diameter of said spool and secured on the top of said spool.

4. The improvement of claim 1 wherein said annular retaining flange means are formed by the upper lateral wall of an annular groove formed in the upper end portion of said spool.

* * * * *